US012104400B2

(12) United States Patent
Liu et al.

(10) Patent No.: US 12,104,400 B2
(45) Date of Patent: Oct. 1, 2024

(54) CLEANING ROBOT FOR SWIMMING POOLS

(71) Applicant: Hubei Yimu Electronic Technology Co., Ltd., Xiantao (CN)

(72) Inventors: Yongchao Liu, Xiantao (CN); Yanshan Han, Xiantao (CN); Rong Xiang, Xiantao (CN); Hao Ding, Xiantao (CN)

(73) Assignee: HUBEI YIMU ELECTRONIC TECHNOLOGY CO., LTD., Xiantao (CN)

( * ) Notice: Subject to any disclaimer, the term of this patent is extended or adjusted under 35 U.S.C. 154(b) by 119 days.

(21) Appl. No.: 17/864,451

(22) Filed: Jul. 14, 2022

(65) Prior Publication Data

US 2023/0374807 A1 Nov. 23, 2023

(30) Foreign Application Priority Data

May 23, 2022 (CN) ..... 202210564954.X

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1654
See application file for complete search history.

(56) References Cited

U.S. PATENT DOCUMENTS

2020/0056391 A1 2/2020 Lancry
2023/0175279 A1* 6/2023 Deng ..... G05D 1/0219 700/245
2023/0212868 A1* 7/2023 Deng ..... G05D 1/0206 134/18

FOREIGN PATENT DOCUMENTS

DE 202011051889 U1 1/2012
WO 2012079027 A2 6/2012

* cited by examiner

*Primary Examiner* — Michael D Jennings
(74) *Attorney, Agent, or Firm* — Bayramoglu Law Offices LLC

(57) ABSTRACT

A cleaning robot for swimming pools includes a charging assembly, a floating assembly, a power assembly and a cleaning assembly. The charging assembly includes a charging mount provided with a first charging induction portion and a first magnet set. The floating assembly includes a floating body, and a second charging induction portion and a second magnet set are disposed on a lateral portion of the floating body. The floating assembly is attracted with the first magnet set of the charging assembly through the second magnet set, and the first charging induction portion and the second charging induction portion are arranged to charge the power assembly after being turned on. The floating assembly and the cleaning assembly are provided with a first and a second travel module for driving the floating assembly and the cleaning assembly respectively. The floating assembly is connected to the cleaning assembly through a power supply cable.

10 Claims, 7 Drawing Sheets

CLEANING ROBOT FOR SWIMMING POOLS

CROSS REFERENCE TO THE RELATED APPLICATIONS

This application is based upon and claims priority to Chinese Patent Application No. 202210564954.X, filed on May 23, 2022, the entire contents of which are incorporated herein by reference.

TECHNICAL FIELD

The invention belongs to the technical fields of cleaning of swimming pools, and particularly relates to a cleaning robot for swimming pools.

BACKGROUND

Water pollutants in swimming pools are important factors that compromising the appearance of the swimming pools, and typically include the following three ones: natural pollutants such as dust, tree leaves, rainwater and insects; artificial chemical agents such as disinfectants, algicides, acid-base balancing agents and water purifier that are added into water in the swimming pools to keep the water clear and sanitary, new pollutants generated by reactions between these chemical agents and other substances in the water, and certain fallen substances formed due to rusting of the structure of the swimming pools; and pollutants brought into swimming pools by swimmers, which are the major source of pollutants in the swimming pools and include exfoliations and excreta of the swimmers.

At present, underwater cleaning robots are developed to remove dirt in swimming pools. There are two types of traditional underwater cleaning robots. One type of the traditional underwater cleaning robots are connected to a control box through a cable and are connected to an AC power supply, so such underwater cleaning robot travel underwater carrying with the cable which is difficult to retrieve, thus being inconvenient to use. The other type of underwater cleaning robots are wireless robots which travel underwater; however, such robots have to be retrieved from water to be charged and it takes a long time to charge such robots, which reduce the usage experience and makes the cleaning efficiency low. In addition, when these robots clean the swimming pools underwater, the working condition of the cleaning robots cannot be known in time, which makes it impossible to make a cleaning plan. So, a novel technical solution for cleaning swimming pools is needed.

SUMMARY

In view of this, the objective of the invention is to provide a cleaning robot for swimming pools to solve the problems of inconvenience in use, low cleaning efficiency and failure to know the working condition of robots of existing technical solutions.

To fulfill the above objective, the invention provides the following technical solution: a cleaning robot for swimming pools includes a charging assembly, a floating assembly, a power assembly and a cleaning assembly.

The charging assembly includes a charging mount provided with a first charging induction portion and a first magnet set; the floating assembly includes a floating body, and a second charging induction portion and a second magnet set are disposed on a lateral portion of the floating body; the floating assembly is attracted with the first magnet set of the charging assembly through the second magnet set, and the first charging induction portion and the second charging induction portion are used for charging the power assembly after being turned on.

The floating assembly is provided with a first travel module used for driving the floating assembly; the cleaning assembly is provided with a second travel module used for driving the cleaning assembly.

The floating assembly is connected to the cleaning assembly through a power supply cable; and the power assembly is used for supplying power to the cleaning assembly, the first travel module and the second travel module.

As a preferred solution of the cleaning robot for swimming pools, the charging assembly further includes a charging stand, the charging stand includes a fixed portion and an adjustable base portion, the fixed portion is connected to a top end of the adjustable base portion, a height adjustment slot is formed in the adjustable base portion, and a sliding lug is formed on an edge of the charging mount and is disposed in the height adjustment slot.

As a preferred solution of the cleaning robot for swimming pools, a data exchange area is disposed at a top of the floating body, is provided with a wireless transmission module, is used for ensuring, through data exchange, that the charging mount and the floating assembly are aligned for charging, and is also used for controlling a working state of the cleaning assembly through data exchange.

As a preferred solution of the cleaning robot for swimming pools, the first travel module includes travel impellers and impeller driving motors; the travel impellers are symmetrically distributed on two sides of the floating body, and the impeller driving motors are disposed in the floating body and are connected to the travel impellers.

As a preferred solution of the cleaning robot for swimming pools, the cleaning assembly includes a cleaning shell, and a cable port is formed in an upper end of the cleaning shell; the power assembly is disposed in the cleaning shell; and the power supply cable penetrates through the cable port to be connected to the power assembly.

As a preferred solution of the cleaning robot for swimming pools, a water outlet is formed in a top of the cleaning shell, and a discharge pump is disposed at the water outlet and is located in the cleaning shell.

A water guide port is formed in a bottom of the cleaning shell, and a one-way valve is disposed at the water guide port.

As a preferred solution of the cleaning robot for swimming pools, a recessed mounting groove is formed in the middle of the bottom of the cleaning shell, and edge mounting areas are formed on front and rear portions of the bottom of the cleaning shell.

A middle cleaning roller brush is disposed in the recessed mounting groove, and edge cleaning roller brushes are disposed in the edge mounting areas.

As a preferred solution of the cleaning robot for swimming pools, the cleaning assembly further includes a dirt collection box connected to an upper end of the cleaning shell, and collection ports of the dirt collection box are aligned with the middle cleaning roller brush and the edge cleaning roller brushes.

As a preferred solution of the cleaning robot for swimming pools, the second travel module includes a travel driving motor, a main driving wheel, driving chains, a middle driving wheel and edge driving wheels.

The travel driving motor is connected to the main driving wheel, the main driving wheel drives the edge driving wheels through the driving chains, and the middle driving wheel is located below the main driving wheel and is engaged with the main driving wheel.

The middle driving wheel is connected to the middle cleaning roller brush, and the edge driving wheels are connected to the edge cleaning roller brushes.

The second travel module further includes limit wheels located on two sides of the main driving wheel and used for limiting the driving chains.

As a preferred solution of the cleaning robot for swimming pools, the cleaning robot for swimming pools further includes a balancing assembly, the balancing assembly includes handles, and lower ends of the handles are hinged to two sides of the cleaning shell; and balancing grooves are symmetrically formed in upper ends of the handles, and balancing buoys are disposed in the balancing grooves.

The invention has the following advantages: the cleaning robot is provided with the charging assembly, the floating assembly, the power assembly and the cleaning assembly; the charging assembly includes the charging mount, and the charging mount is provided with the first charging induction portion and the first magnet set; the floating assembly includes the floating body, and the second charging induction portion and the second magnet set are disposed on the lateral portion of the floating body; the floating assembly is attracted with the first magnet set of the charging assembly through the second magnet set, and after being turned on, the first charging induction portion and the second charging induction portion are used for charging the power assembly; the floating assembly is provided with the first travel module used for driving the floating assembly; the cleaning assembly is provided with the second travel module used for driving the cleaning assembly; the floating assembly is connected to the cleaning assembly through the power supply cable; and the power module is used for supplying power to the cleaning assembly, the first travel module and the second travel module. The cleaning robot is provided with a rechargeable power assembly, so that a long cable is not needed, the complex operation of cable retrieval is omitted, and the situation that normal operation of the cleaning assembly is affected due to cable entwining is avoided; the cleaning robot can be charged directly without being manually taken out of water, so that user experience is good, and the cleaning efficiency is high; and the working position of the cleaning robot can be known in time, and the cleaning robot can automatically plan the cleaning path, thus being more intelligent.

BRIEF DESCRIPTION OF THE DRAWINGS

To more clearly explain the implementations of the invention or the technical solution of the prior art, drawings used for describing the implementations of the invention or the prior art will be introduced briefly below. Obviously, the drawings in the following description are merely illustrative, and those ordinarily skilled in the art may obtain other drawings according to those provided without creative labor.

The structure, scale and size illustrated by the drawings in the specification are merely used to allow those skilled in the art to understand and read the specification together with the contents disclosed in this specification, are not used to limit the implementations of the invention, and thus, do not have any technical substantive meanings. Any modifications to the structure, changes to the scale or adjustments to the size made without influencing the effects and purposes of the invention still fall within the scope defined by the technical contents of the invention.

Figure 1:
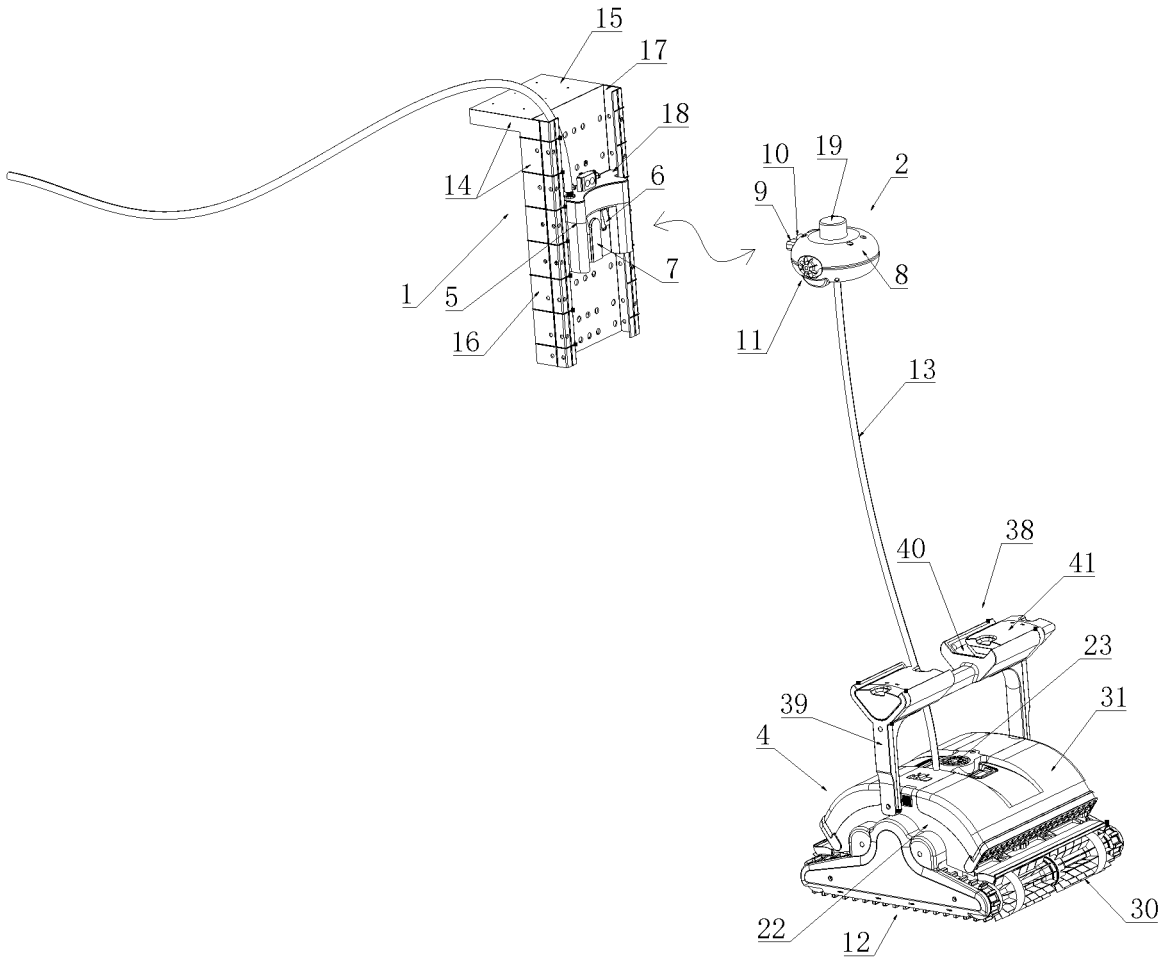
FIG. 1 is an exploded view of a cleaning robot for swimming pools according to one embodiment of the invention.

In the figures: 1, charging assembly; 2, floating assembly; 3, power assembly; 4, cleaning assembly; 5, charging mount; 6, first charging induction portion; 7, first magnet set; 8, floating body; 9, second charging induction portion; 10, second magnet set; 11, first travel module; 12, second travel module; 13, power supply cable; 14, charging stand; 15, fixed portion; 16, adjustable base portion; 17, height adjustment slot; 18, sliding lug; 19, data exchange area; 20, travel impeller; 21, impeller driving motor; 22, cleaning shell; 23, water outlet; 24, discharge pump; 25, water guide port; 26, one-way valve; 27, recessed mounting groove; 28, edge mounting area; 29, middle cleaning roller brush; 30, edge cleaning roller brush; 31, dirt collection box; 32, travel driving motor; 33, main driving wheel; 34, driving chain; 35, middle driving wheel; 36, edge driving wheel; 37, limit wheel; 38, balancing assembly; 39, handle; 40, balancing groove; 41, balancing buoy.

DETAILED DESCRIPTION OF THE EMBODIMENTS

The implementations of the invention will be explained with specific embodiments below. Any skilled in the art may easily understand other advantages and effects of the invention according to the contents disclosed in this specification. Obviously, the embodiments in the following description are merely illustrative ones, and are not all possible ones of the invention. All other embodiments obtained by those ordinarily skilled in the art based on the following ones without creative labor should also fall within the protection scope of the invention.

Referring to FIG. 1, FIG. 2, FIG. 3, FIG. 4, FIG. 5, FIG. 6 and FIG. 7, one embodiment of the invention provides a cleaning robot for swimming pools, including a charging assembly 1, a floating assembly 2, a power assembly 3 and a cleaning assembly 4.

The charging assembly 1 includes a charging mount 5, wherein the charging mount 5 is provided with a first charging induction portion 6 and a first magnet set 7; the floating assembly 2 includes a floating body 8, and a second charging induction portion 9 and a second magnet set 10 are disposed on a lateral portion of the floating body 8; and the floating assembly 2 is attracted with the first magnet set 7 of the charging assembly 1 through the second magnet set 10, and the first charging induction portion 6 and the second charging induction portion 9 are used for charging the power assembly 3 after being turned on.

The floating assembly 2 is provided with a first travel module 11 used for driving the floating assembly 2; the cleaning assembly 4 is provided with a second travel module 12 used for driving the cleaning assembly 4.

The floating assembly 2 is connected to the cleaning assembly 4 through a power supply cable 13; the power assembly 3 is used for supplying power to the cleaning assembly 4, the first travel module 11 and the second travel module 12.

Figure 2:
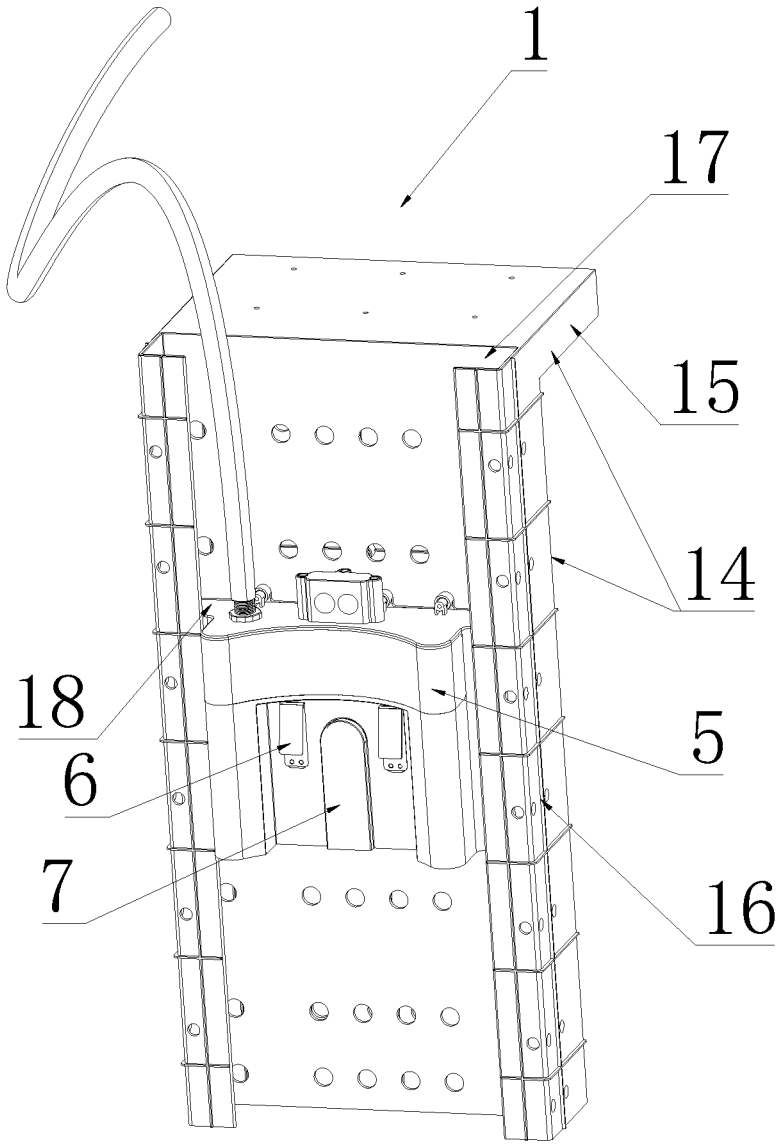
FIG. 2 is a structural diagram of a charging assembly of the cleaning robot for swimming pools according to one embodiment of the invention.

Referring to FIG. 2, in this embodiment, the charging assembly 1 further includes a charging stand 14, wherein the charging stand 14 includes a fixed portion 15 and an adjustable base portion 16, the fixed portion 15 is connected to a top end of the adjustable base portion 16, a height adjustment slot 17 is formed in the adjustable base portion 16, and a sliding lug 18 is formed on an edge of the charging mount 5 and is disposed in the height adjustment slot 17.

Specifically, in the normal state, the charging assembly 1 is arranged at the side of a swimming pool, that is, the charging stand 14 is fixed at the side of the swimming pool; the fixed portion 15 is disposed on the ground at the side of the swimming pool; the adjustable base portion 16 is disposed on a wall of the swimming pool and is located above the water surface of the swimming pool to charge the power assembly 3.

When the power assembly 3 needs to be charged, the cleaning robot moves to a charging position, the floating assembly 2 is connected to the charging assembly 1, and the first magnet set 7 and the second magnet set 10 are attracted together, so that the first charging induction portion 6 and the second charging induction portion 9 are turned on to charge the power assembly 3 of the cleaning robot. The power assembly 3 is charged in a wired manner or in a wireless induction manner. When the power assembly 3 is charged in a wired manner, the first charging induction portion 6 and the second charging induction portion 9 are electrically conductive metal sheets. When the power assembly 3 is charged in a wireless induction manner, the first charging induction portion 6 is integrated with a power supply coil, the second charging induction portion 9 is integrated with a power reception coil, and when the first magnet set 7 and the second magnet set 10 are attracted together, the power supply coil and the power reception coil charge the power assembly 3 in an electromagnetic induction manner, based on a principle the same as wireless charging of existing smartphones.

Because the water level in the swimming pool may change, the height of the charging mount 5 may be adjusted through the sliding lug 18 and the height adjustment slot 17 to prevent the charging assembly 1 from being immersed in water in the swimming pool. It can be understood that the height of the charging mount 5 may be adjusted automatically without manual intervention by detecting or sensing the water level in the swimming pool.

Figure 3:
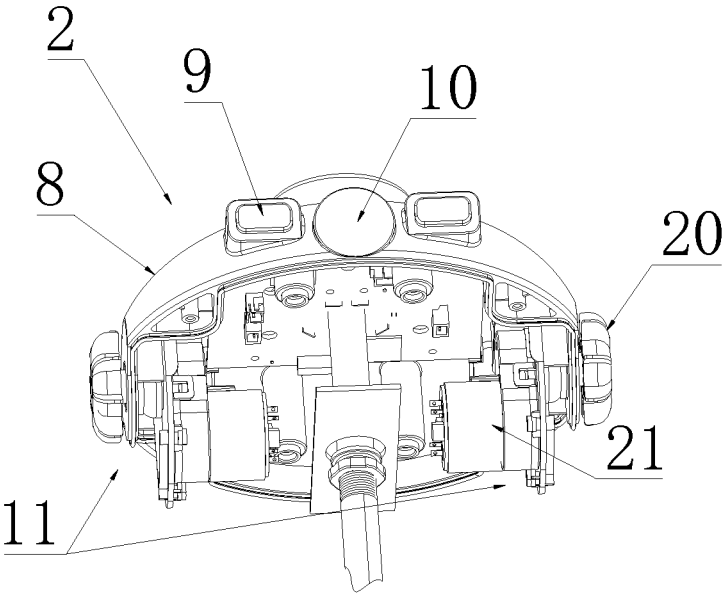
FIG. 3 is a structural diagram of a floating assembly of the cleaning robot for swimming pools according to one embodiment of the invention.

Referring to FIG. 3, in this embodiment, a data exchange area 19 is disposed at the top of the floating body 8, is provided with a wireless transmission module, is used for ensuring, through data exchange, that the charging mount 5 and the floating assembly 2 are aligned for charging, and is also used for controlling the working state of the cleaning assembly 4 through data exchange.

Specifically, the wireless transmission module is preferably a Wi-Fi module and can realize data exchange and wireless intelligent control of the cleaning robot, and a remote control or a control terminal may be configured correspondingly to control the cleaning robot remotely.

Referring to FIG. 3 again, in this embodiment, the first travel module 11 includes travel impellers 20 and impeller driving motors 21; the travel impellers 20 are symmetrically distributed on two sides of the floating body 8, and the impeller driving motors 21 are disposed in the floating body 8 and are connected to the travel impellers 20.

Specifically, the first travel module 11 allows the floating assembly 2 to travel on the surface of water. Specifically, the impeller driving motors 21 drive the travel impellers 20 to rotate, the travel impellers 20 stroke on the surface of water, and thus, the floating assembly 2 is driven by the first travel module 11 to move.

An application may be used to send a WIFI signal to the first travel module 11 of the floating assembly 2 to remotely control the robot to travel and obtain the working state of the robot.

Referring to FIG. 4, FIG. 5, FIG. 6 and FIG. 7, in this embodiment, the cleaning assembly 4 includes a cleaning shell 22, and a cable port is disposed at an upper end of the cleaning shell 2; the power assembly 3 is disposed in the cleaning shell 22; the power supply cable 13 penetrates through the cable port to be connected to the power assembly 3. A water outlet 23 is formed in the top of the cleaning shell 22, and a discharge pump 24 is disposed at the water outlet 23 and is located in the cleaning shell 22; a water guide port 25 is formed in the bottom of the cleaning shell 22, and a one-way valve 26 is disposed at the water guide port 25. A recessed mounting groove 27 is formed in the middle of the bottom of the cleaning shell 22, and edge mounting areas 28 are formed on front and rear portions of the bottom of the cleaning shell 22. A middle cleaning roller brush 29 is disposed in the recessed mounting groove 27, and edge cleaning roller brushes 30 are disposed in the edge mounting areas 28. The cleaning assembly 4 further includes a dirt collection box 31 connected to the upper end of the cleaning shell 22, and collection ports of the dirt collection box 31 are aligned with the middle cleaning roller brush 29 and the edge cleaning roller brushes 30

Specifically, the cleaning shell 22 carries the cleaning assembly 4 and the second travel module 12. In the working state, the power assembly 3 supplies power to the floating assembly 2 and the first travel module 11 through the power supply cable 13. The water outlet 23 and a water guide port 25 are designed to guide water in the operation of the discharge pump 24 to allow dirt to be collected into the dirt collection box 31 through the cleaning assembly 4. Through the design of the recessed mounting groove 27 and the edge mounting areas 28, the whole cleaning assembly 4 is more compact in structure; the middle and the front and back sides are cleaned through the middle cleaning roller brush 29 and the edge cleaning roller brushes 30 respectively, so that the cleaning effect is better.

Figure 4:
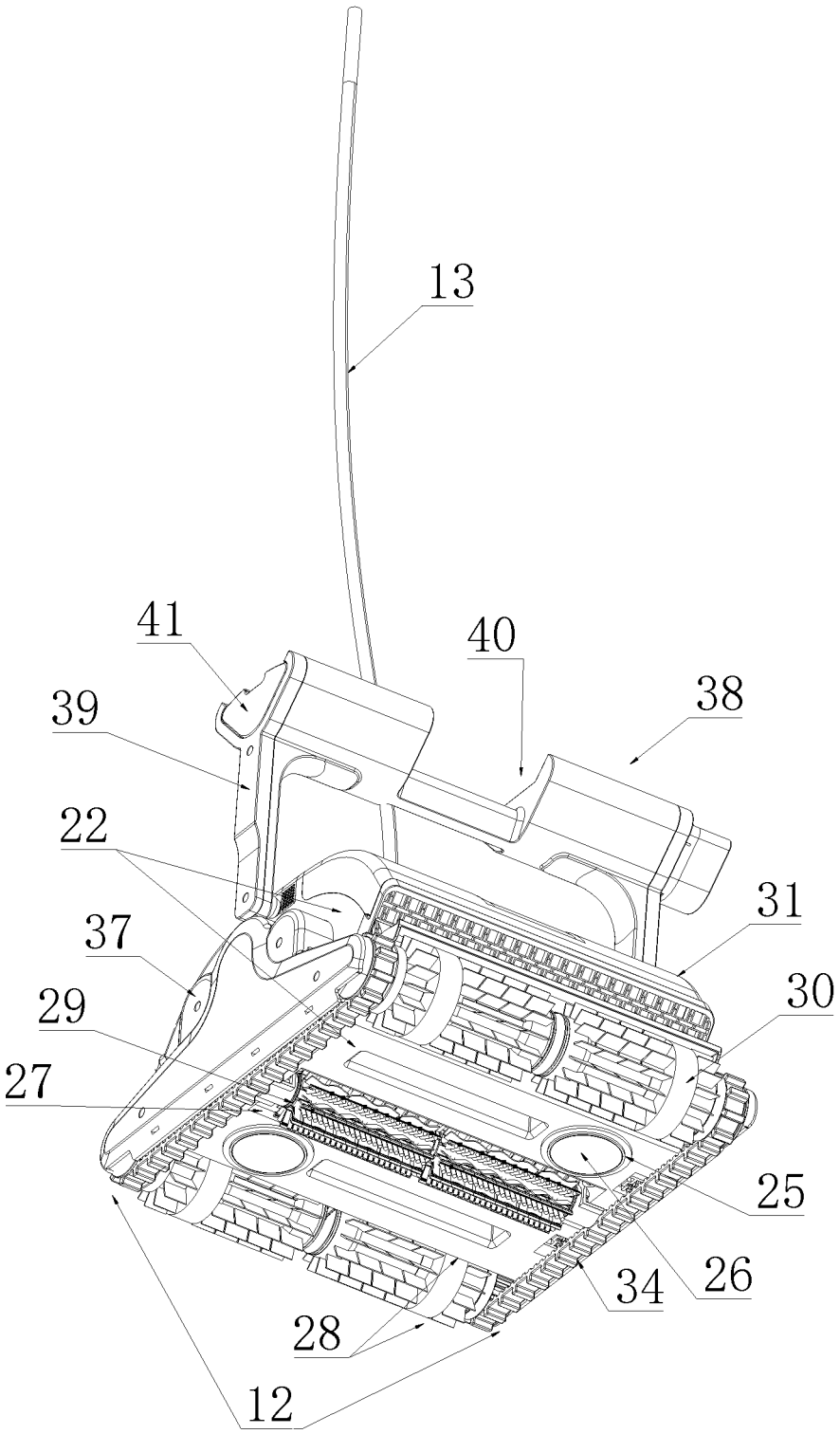
FIG. 4 is a structural diagram of a cleaning assembly of the cleaning robot for swimming pools according to one embodiment of the invention.
Figure 5:
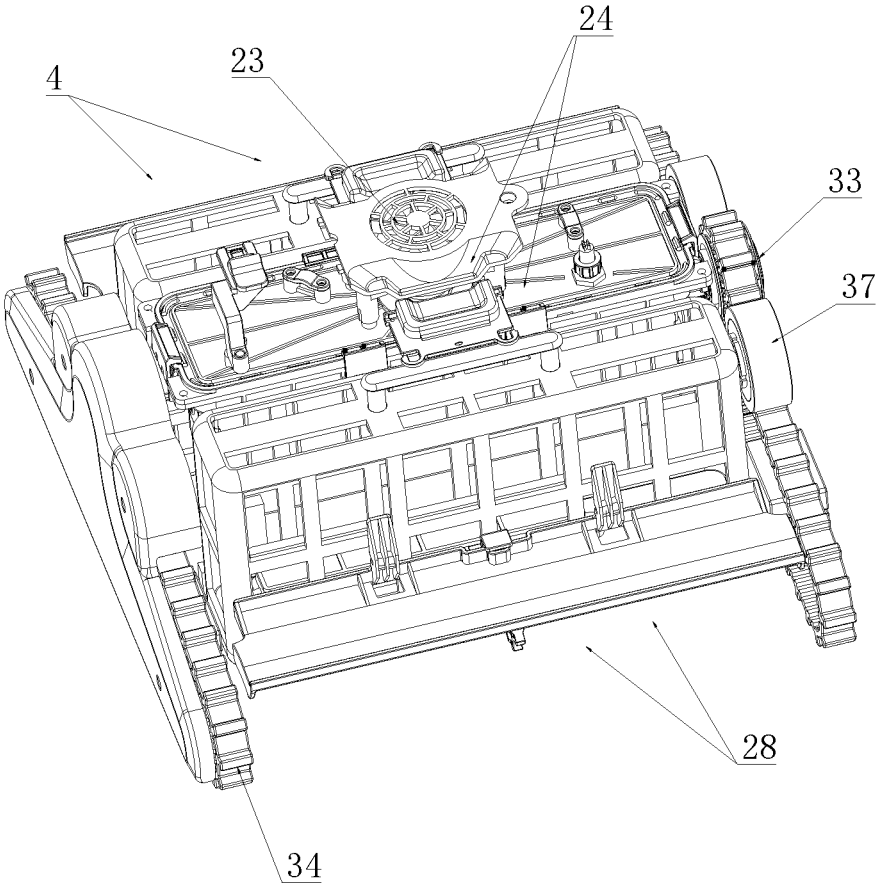
FIG. 5 is an internal structural view of the cleaning assembly of the cleaning robot for swimming pools according to one embodiment of the invention.
Figure 6:
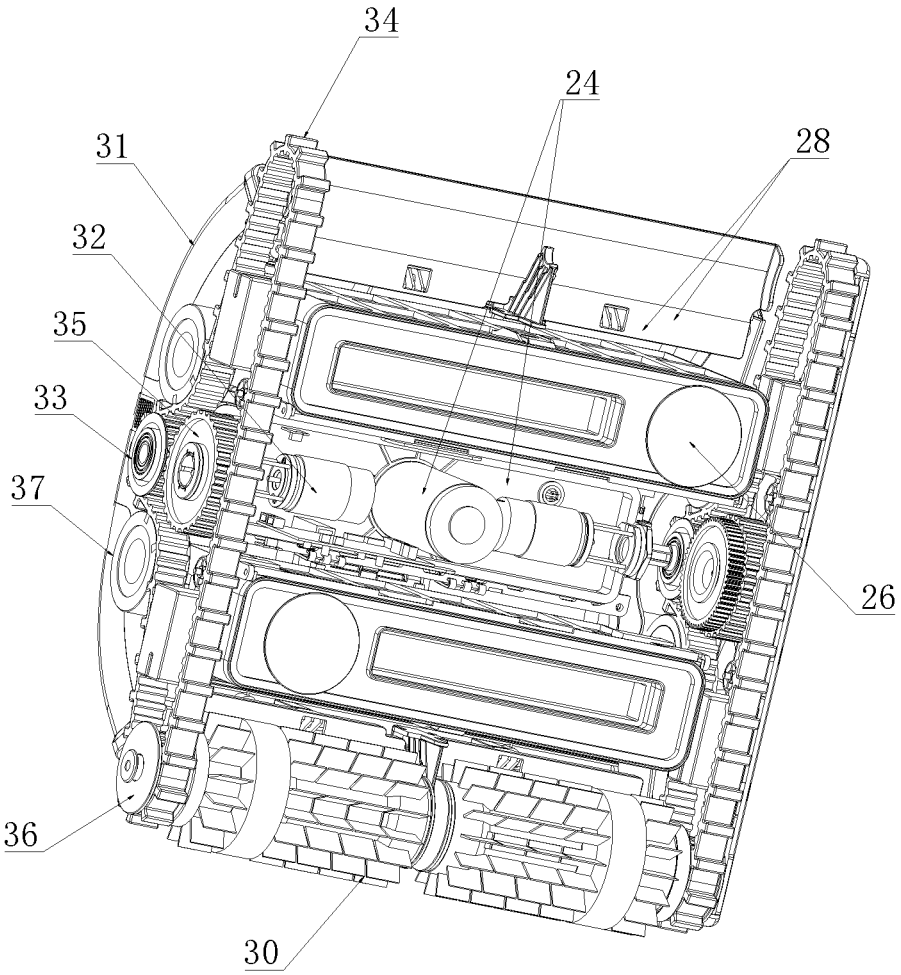
FIG. 6 is an internal structural view, from another perspective, of the cleaning assembly of the cleaning robot for swimming pools according to one embodiment of the invention.
Figure 7:
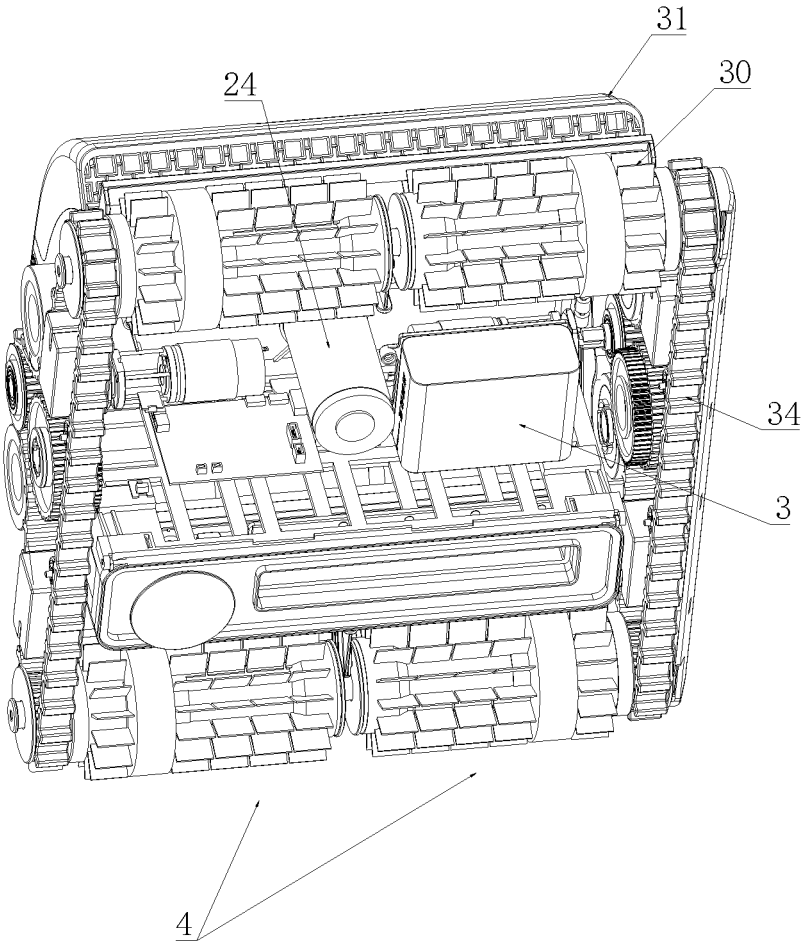
FIG. 7 is a schematic diagram of a power assembly of the cleaning robot for swimming pools according to one embodiment of the invention.

Referring to FIG. 4, FIG. 5, FIG. 6 and FIG. 7 again, in this embodiment, the second travel module 12 includes a travel driving motor 32, a main driving wheel 33, driving chains 34, a middle driving wheel 35 and edge driving wheels 36, wherein the travel driving motor 32 is connected to the main driving wheel 33, the main driving wheel 33 drives the edge driving wheels 36 through the driving chains 34, the middle driving wheel 35 is located below the main driving wheel 33, and the middle driving wheel 35 is engaged with the main driving wheel 33; the middle driving wheel 35 is connected to the middle cleaning roller brush 29, and the edge driving wheels 35 are connected to the edge cleaning roller brushes 30; and the second travel module 12 further includes limit wheels 37 located on two sides of the main driving wheel 33 and used for limiting the driving chains 36.

Specifically, the power assembly 3 supplies power to the travel driving motor 32. During work, the travel driving motor 32 drives the main driving wheel 33 to operate, the main driving wheel 33 drives the edge driving wheels 36 to operate through the driving chains 34, the driving chains 34 rotate to drive the cleaning assembly 4 to travel underwater, and the edge driving wheels 36 rotate to drive the edge cleaning roller brushes 30 to rotate so as to drive the edge cleaning roller brushes 30 to realize cleaning. In addition, when the main driving wheel 33 operates, the middle driving wheel 35 engaged with the main driving wheel 33 is driven to operate, which in turn drives the middle cleaning roller brush 29 to rotate to realize cleaning. The limit wheels 37 are designed to improve the stability of the driving chains 34 and can adjust the degree of tension of the driving chains 34.

In this embodiment, the cleaning robot further includes a balancing assembly 38, wherein the balancing assembly 38 includes handles 39, and lower ends of the handles 39 are hinged to two sides of the cleaning shell 22; balancing grooves 40 are symmetrically formed in upper ends of the handles 39, and balancing buoys 41 are disposed in the balancing grooves 40.

Specifically, the balancing assembly 38 can rotate with respect to the cleaning shell 22, the cleaning assembly 4 can be lifted through the handles 39, and the balancing grooves 40 in the handles 39 realize a balancing effect through the balancing buoys 41, so the cleaning assembly 4 can be stably driven by the second travel module 12 underwater.

It can be understood that the first travel module 11 and the second travel module 12 may be driven at the same time to ensure the synchronousness of the floating assembly 2 and the cleaning assembly 4. Meanwhile, the cleaning path of the cleaning robot can be planned reasonably through an existing path planning algorithm to realize comprehensive cleaning of the swimming pool.

It should be noted that the power assembly 3 involved in this technical solution may be a rechargeable lithium battery, and circuits for the wireless transmission module, charging, motor driving and remote control all belong to the prior art.

From the above description, the cleaning robot for swimming pools is provided with the charging assembly 1, the floating assembly 2, the power assembly 3 and the cleaning assembly 4; the charging assembly 1 includes the charging mount 5, and the charging mount 5 is provided with the first charging induction portion 6 and the first magnet set 7; the floating assembly 2 includes the floating body 8, and the second charging induction portion 9 and the second magnet set 10 are disposed on the lateral portion of the floating body 8; the floating assembly 2 is attracted with the first magnet set 7 of the charging assembly 1 through the second magnet set 10, and after being turned on, the first charging induction portion 6 and the second charging induction portion 9 are used for charging the power assembly 3; the floating assembly 2 is provided with the first travel module 11 used for driving the floating assembly 2; the cleaning assembly 4 is provided with the second travel module 12 used for driving the cleaning assembly 4; the floating assembly 2 is connected to the cleaning assembly 4 through the power supply cable 13; and the power module 3 is used for supplying power to the cleaning assembly 4, the first travel module 11 and the second travel module 12. In the normal state, the charging assembly 1 is arranged at the side of a swimming pool, that is, the charging stand 14 is fixed at the side of the swimming pool; the fixed portion 15 is disposed on the ground at the side of the swimming pool; the adjustable base portion 16 is disposed on a wall of the swimming pool and is located above the water surface of the swimming pool to charge the power assembly 3. When the power assembly 3 needs to be charged, the cleaning robot moves to a charging position, the floating assembly 2 is connected to the charging assembly 1, and the first magnet set 7 and the second magnet set 10 are attracted together, so that the first charging induction portion 6 and the second charging induction portion 9 are turned on to charge the power assembly 3 of the cleaning robot. Because the water level in the swimming pool may change, the height of the charging mount 5 may be adjusted through the sliding lug 18 and the height adjustment slot 17 to prevent the charging assembly 1 from being immersed in water in the swimming pool. The first travel module 11 allows the floating assembly 2 to travel on the surface of water, the impeller driving motors 21 drive the travel impellers 20 to rotate, and the travel impellers 20 stroke on the surface of water, so that the floating assembly 2 is driven by the first travel module 11 to move. The cleaning shell 22 carries the cleaning assembly 4 and the second travel module 12. In the working state, the power assembly 3 supplies power to the floating assembly 2 and the first travel module 11 through the power supply cable 13. The water outlet 23 and a water guide port 25 are designed to guide water in the operation of the discharge pump 24 to allow dirt to be collected into the dirt collection box 31 through the cleaning assembly 4. Through the design of the recessed mounting groove 27 and the edge mounting areas 28, the whole cleaning assembly 4 is more compact in structure; and the middle and the front and back sides are cleaned through the middle cleaning roller brush 29 and the edge cleaning roller brushes 30 respectively, so that the cleaning effect is better. The power assembly 3 supplies power to the travel driving motor 32; during work, the travel driving motor 32 drives the main driving wheel 33 to operate, the main driving wheel 33 drives the edge driving wheels 36 to operate through the driving chains 34, the driving chains 34 rotate to drive the cleaning assembly 4 to travel underwater, and the edge driving wheels 36 rotate to drive the edge cleaning roller brushes 30 to rotate so as to drive the edge cleaning roller brushes 30 to realize cleaning. In addition, when the main driving wheel 33 operates, the middle driving wheel 35 engaged with the main driving wheel 33 is driven to operate, which in turn drives the middle cleaning roller brush 29 to rotate to realize cleaning. The limit wheels 37 are designed to improve the stability of the driving chains 34 and can adjust the degree of tension of the driving chains 34. The balancing assembly 38 can rotate with respect to the cleaning shell 22, the cleaning assembly 4 can be lifted through the handles 39, and the balancing grooves 40 in the handles 39 realize a balancing effect through the balancing buoys 41, so the cleaning assembly 4 can be stably driven by the second travel module 12 underwater. The cleaning robot is provided with the rechargeable power assembly 4, so that a long cable is not needed, the complex operation of cable retrieval is omitted, and the situation that normal operation of the cleaning assembly is affected due to cable entwining is avoided; the cleaning robot can be charged directly without being manually retrieved from water, so that the usage experience is good, and the cleaning efficiency is high; and the working position of the cleaning robot can be known in time, and the cleaning robot can automatically plan the cleaning path, thus being more intelligent.

Although the invention has been described in detail above with general introductions and specific embodiments, it is obvious for those skilled in the art to make some modifications or improvements on the basis of the invention. Thus, all these modifications or improvements made without departing from the spirit of the invention should fall within the protection scope of the invention.

What is claimed is:

1. A cleaning robot for swimming pools, comprising a charging assembly, a floating assembly, a power assembly and a cleaning assembly, wherein:

the charging assembly comprises a charging mount, wherein the charging mount is provided with a first charging induction portion and a first magnet set;

the floating assembly comprises a floating body, wherein a second charging induction portion and a second magnet set are disposed on a lateral portion of the floating body;

the floating assembly is attracted with the first magnet set of the charging assembly through the second magnet set, and the first charging induction portion and the second charging induction portion are used for charging the power assembly after the first charging induction portion and the second charging induction portion are turned on;

the floating assembly is provided with a first travel module used for driving the floating assembly;

the cleaning assembly is provided with a second travel module used for driving the cleaning assembly;

the floating assembly is connected to the cleaning assembly through a power supply cable;

and the power assembly is used for supplying power to the cleaning assembly, the first travel module and the second travel module.

2. The cleaning robot for the swimming pools according to claim 1, wherein the charging assembly further comprises a charging stand;

the charging stand comprises a fixed portion and an adjustable base portion, wherein the fixed portion is connected to a top end of the adjustable base portion;

a height adjustment slot is formed in the adjustable base portion; and a sliding lug is formed on an edge of the charging mount, and the sliding lug is disposed in the height adjustment slot.

3. The cleaning robot for the swimming pools according to claim 2, wherein the first travel module comprises travel impellers and impeller driving motors; and the travel impellers are symmetrically distributed on two sides of the floating body, the impeller driving motors are disposed in the floating body, and the impeller driving motors are connected to the travel impellers.

4. The cleaning robot for the swimming pools according to claim 1, wherein a data exchange area is disposed at a top of the floating body;

the data exchange area is provided with a wireless transmission module;

through data exchange, the data exchange area ensures that the charging mount and the floating assembly are aligned for charging; and the data exchange area is further used for controlling a working state of the cleaning assembly.

5. The cleaning robot for the swimming pools according to claim 1, wherein the cleaning assembly comprises a cleaning shell, and a cable port is formed in an upper end of the cleaning shell;

the power assembly is disposed in the cleaning shell; and the power supply cable penetrates through the cable port to be connected to the power assembly.

6. The cleaning robot for the swimming pools according to claim 5, wherein a water outlet is formed in a top of the cleaning shell, a discharge pump is disposed at the water outlet, and the discharge pump is located in the cleaning shell; and a water guide port is formed in a bottom of the cleaning shell, and a one-way valve is disposed at the water guide port.

7. The cleaning robot for the swimming pools according to claim 6, wherein a recessed mounting groove is formed in a middle of the bottom of the cleaning shell, and edge mounting areas are formed on front and rear portions of the bottom of the cleaning shell; and a middle cleaning roller brush is disposed in the recessed mounting groove, and edge cleaning roller brushes are disposed in the edge mounting areas.

8. The cleaning robot for the swimming pools according to claim 7, wherein the cleaning assembly further comprises a dirt collection box, wherein the dirt collection box is connected to an upper end of the cleaning shell, and collection ports of the dirt collection box are aligned with the middle cleaning roller brush and the edge cleaning roller brushes.

9. The cleaning robot for the swimming pools according to claim 8, wherein the second travel module comprises a travel driving motor, a main driving wheel, driving chains, a middle driving wheel, edge driving wheels and limit wheels;

the travel driving motor is connected to the main driving wheel;

the main driving wheel drives the edge driving wheels through the driving chains;

the middle driving wheel is located below the main driving wheel, and the middle driving wheel is engaged with the main driving wheel;

the middle driving wheel is connected to the middle cleaning roller brush, and the edge driving wheels are connected to the edge cleaning roller brushes; and the limit wheels are located on two sides of the main driving wheel, and the limit wheels are used for limiting the driving chains.

10. The cleaning robot for the swimming pools according to claim 9, further comprising a balancing assembly;

wherein the balancing assembly comprises handles;

lower ends of the handles are hinged to two sides of the cleaning shell;

balancing grooves are symmetrically formed in upper ends of the handles; and balancing buoys are disposed in the balancing grooves.

* * * * *